US008038932B2

(12) United States Patent
Weber

(10) Patent No.: US 8,038,932 B2
(45) Date of Patent: Oct. 18, 2011

(54) METALLURGICAL VESSEL

(75) Inventor: Stephan Heinz Josef Victor Weber, South Perth (AU)

(73) Assignee: Technological Resources Pty. Limited, Melbourne (AU)

( * ) Notice: Subject to any disclaimer, the term of this patent is extended or adjusted under 35 U.S.C. 154(b) by 744 days.

(21) Appl. No.: 10/587,933

(22) PCT Filed: Feb. 3, 2005

(86) PCT No.: PCT/AU2005/000139
§ 371 (c)(1),
(2), (4) Date: May 6, 2008

(87) PCT Pub. No.: WO2005/075688
PCT Pub. Date: Aug. 18, 2005

(65) Prior Publication Data

US 2008/0203630 A1 Aug. 28, 2008

(30) Foreign Application Priority Data

Feb. 4, 2004 (AU) ..... 2004900544

(51) Int. Cl.
*C21B 7/10* (2006.01)

(52) U.S. Cl. ..... 266/241; 266/280

(58) Field of Classification Search ..... 266/241, 266/280
See application file for complete search history.

(56) References Cited

U.S. PATENT DOCUMENTS

| | | | | |
|---|---|---|---|---|
| 4,669,708 | A | 6/1987 | Rollot et al. | |
| 4,787,605 | A | 11/1988 | Kaptein | |
| 6,267,799 | B1 | 7/2001 | Innes et al. | |
| 6,322,745 | B1 | 11/2001 | Leigh et al. | |
| 6,565,798 | B2 | 5/2003 | Gurr et al. | |
| 7,364,691 | B2 * | 4/2008 | Barker et al. | 266/275 |
| 2005/0218569 | A1 | 10/2005 | Stastny et al. | |
| 2006/0208400 | A1 | 9/2006 | Schmeier | |
| 2007/0290419 | A1 * | 12/2007 | Goodman et al. | 266/189 |

FOREIGN PATENT DOCUMENTS

| | | |
|---|---|---|
| DE | 102 30 511 | 8/2003 |
| EP | 0 052 039 | 5/1982 |

(Continued)

OTHER PUBLICATIONS

English language Translation of JP 2002-206107A Jul. 2002.*

*Primary Examiner* — Scott Kastler
(74) *Attorney, Agent, or Firm* — Finnegan, Henderson, Farabow, Garrett & Dunner, L.L.P.

(57) ABSTRACT

Cooling panels (31) are attached to the shell (11) of a metallurgical vessel to form an internal lining of the shell. Each panel (31) comprises a coolant flow tube (36) bent to form inner and outer panel sections (37, 38) of zig-zag formation. Panel mounting pins (43) connected to the outer panel section (38) by connector straps project laterally outwardly from the panel through openings (45) in the shell and tubular shell protrusions (46) surrounding the openings (45). The ends of pins (43) are connected to the outer ends of protrusions (46) by welding metal discs (47) thus forming connections exteriorly of the shell in a way which seals the openings (45). Coolant inlet and outlet connectors (42) for the panel project outwardly through openings (48) in the shell and surrounding tubular protrusions (49) and connections are made by welding discs (51) between the connectors (42) and protrusions (49).

38 Claims, 8 Drawing Sheets

FOREIGN PATENT DOCUMENTS

| | | | | |
|---|---|---|---|---|
| GB | 2 009 898 | | | 6/1979 |
| GB | 2 344 639 | | | 6/2000 |
| JP | 2002206107 | A | * | 7/2002 |
| JP | 2003-279265 | | | 10/2003 |
| SU | 0840112 | | | 6/1981 |
| WO | WO 96/31627 | | | 10/1996 |
| WO | WO 00/01854 | | | 1/2000 |
| WO | WO 00/63446 | | | 10/2000 |
| WO | WO 02/088398 | | | 11/2002 |
| WO | WO 2004/106831 | | | 12/2004 |

* cited by examiner

METALLURGICAL VESSEL

TECHNICAL FIELD

The present invention relates to the construction of metallurgical vessels in which metallurgical processes are performed. The invention has particular but not exclusive application to vessels used for performing direct smelting to produce molten metal in pure or alloy form from a metalliferous feed material such as ores, partly reduced ores and metal-containing waste streams.

A known direct smelting process, which relies principally on a molten metal layer as a reaction medium, and is generally referred to as the HIsmelt process, is described in U.S. Pat. No. 6,267,799 and International Patent Publication WO 96/31627 in the name of the applicant. The HIsmelt process as described in these publications comprises:

(a) forming a bath of molten iron and slag in a vessel;

(b) injecting into the bath:

(i) a metalliferous feed material, typically metal oxides; and (ii) a solid carbonaceous material, typically coal, which acts as a reductant of the metal oxides and a source of energy; and (c) smelting metalliferous feed material to metal in the metal layer.

The term "smelting" is herein understood to mean thermal processing wherein chemical reactions that reduce metal oxides take place to produce liquid metal.

The HIsmelt process also comprises post-combusting reaction gases, such as CO and $H_2$ released from the bath, in the space above the bath with oxygen-containing gas and transferring the heat generated by the post-combustion to the bath to contribute to the thermal energy required to smelt the metalliferous feed materials.

The HIsmelt process also comprises forming a transition zone above the nominal quiescent surface of the bath in which there is a favourable mass of ascending and thereafter descending droplets or splashes or streams of molten metal and/or slag which provide an effective medium to transfer to the bath the thermal energy generated by post-combusting reaction gases above the bath.

In the HIsmelt process the metalliferous feed material and solid carbonaceous material is injected into the metal layer through a number of lances/tuyeres which are inclined to the vertical so as to extend downwardly and inwardly through the side wall of the smelting vessel and into the lower region of the vessel so as to deliver the solids material into the metal layer in the bottom of the vessel. To promote the post combustion of reaction gases in the upper part of the vessel, a blast of hot air, which may be oxygen enriched, is injected into the upper region of the vessel through the downwardly extending hot air injection lance. Offgases resulting from the post-combustion of reaction gases in the vessel are taken away from the upper part of the vessel through an offgas duct.

The HIsmelt process enables large quantities of molten metal to be produced by direct smelting in a single compact vessel. This vessel must function as a pressure vessel containing solids, liquids and gases at very high temperatures throughout a smelting operation which can be extended over a long period. As described in U.S. Pat. No. 6,322,745 and International Patent Publication WO 00/01854 in the name of the applicant the vessel may consist of a steel shell with a hearth contained therein formed of refractory material having a base and sides in contact with at least the molten metal and side walls extending upwardly from the sides of the hearth that are in contact with the slag layer and the gas continuous space above, with at least part of those side walls consisting of water cooled panels. Such panels may be of a double serpentine shape with rammed or gunned refractory interspersed between. Other metallurgical vessels have been provided with internal refractories and refractory cooling systems. In a conventional iron making blast furnace for example, the cooling system generally comprises a series of cooling staves of robust cast iron construction capable of withstanding the forces generated by the large quantities of burden extending upwardly through the column of the blast furnace. These staves are only replaced during a reline, during which the blast furnace shuts down for an extended period. These days the period between relines for a blast furnace which operates continuously can be over twenty years and a reline extends over a number of months.

Electric arc furnaces, such as those used for the batch production of steel on the other hand, may employ cooling panels which are simply suspended from a support cage which can be accessed when the lid is removed and are treated almost like consumables. They can be replaced and/or repaired during other scheduled down times or between heats.

The metallurgical vessel for performing the HIsmelt process presents unique problems in that the process operates continuously, and the vessel must be closed up as a pressure vessel for long periods, typically of the order of a year or more and then must be quickly relined in a short period of time as described in U.S. Pat. No. 6,565,798 in the name of the applicant. This requires the installation of internal water cooling panels in an area to which there is limited access. Moreover, it is most desirable that damaged panels can be replaced without interfering with the integrity of the outer shell and its performance as a pressure vessel.

DISCLOSURE OF THE INVENTION

The present invention provides a metallurgical vessel comprising:

an outer shell; and a plurality of cooling panels attached to the shell to form an interior lining therefor for at least an upper part of the vessel, each panel having internal passages for flow of coolant therethrough;

wherein each panel is provided with a plurality of projections projecting laterally of that panel and extended through openings in the outer shell of the vessel and connected to the shell exteriorly of the shell in connections which seal the openings.

The shell may be provided with tubular protrusions surrounding said openings and protruding outwardly from the shell and said connections may connect said projections to outer ends of the tubular protrusions.

The cooling panels may be lined interiorly of the vessel with refractory material to form an interior refractory lining for the vessel, the cooling panels being operable by flow of coolant through said passages to cool the refractory material.

Said projections may be of elongate formation and may project laterally of the panel in mutually parallel relationship to one another.

Said projections may include a series of pins.

Said projections may further comprise tubular coolant inlet and outlet connectors for the panel.

The vessel shell may include a generally cylindrical section lined with a series of said cooling panels.

The panels of that series may be of elongate arcuate formation with a curvature to match the curvature of the generally cylindrical section of the vessel.

The arcuate panels may be disposed in vertically spaced tiers of panels spaced circumferentially of the vessel.

The panels may be closely spaced and in order to reduce the gaps required between the circumferentially spaced panels to permit removal of each panel by bodily movement thereof, there may be at least six circumferentially spaced panels in each tier. More specifically, these may be of the order of eight panels in each tier.

The panels may be comprised of coolant flow tubes shaped to zigzag formations to form the panels. In that case, the projections may be comprised of pins attached to the zigzag tube formations and tubular coolant and inlet and outlet connectors extending from ends of the zigzag tubular formations.

Each panel may have inner and outer zigzag formations forming inner and outer panel sections relative to the vessel shell.

In use of the vessel water may be passed through the internal passages of the panels to serve as the coolant.

The invention also provides a method of mounting a cooling panel on an outer shell of a metallurgical vessel so as to form part of an internal lining of that shell, comprising:

providing the cooling panel with a plurality of projections projecting laterally from the panel, extending the projections through openings in the shell to bring the panel into a position in which it lines part of the interior of the shell, forming connections between the projections and the shell exteriorly of the shell which connections seal the openings.

The invention further provides a cooling panel for mounting on an outer shell of a metallurgical vessel so as to form part of an internal lining of that shell, comprising:

a panel body having an internal passage means for flow of coolant therethrough, and a plurality of projections projecting laterally of the panel to one side of the panel body and capable of supporting the panel when extended through openings in the shell and connected to the shell exteriorly of the vessel.

The panel body may comprise a coolant flow tube shaped to a zig-zag formation.

More specifically, the panel body may be formed of a single coolant tube shaped to form adjacent inner and outer panel sections of zig-zag formation and said projections may project laterally outwardly from the outer panel section.

The panel may be of elongate arcuate formation.

The outer panel section may be disposed on the outer side of the panel curve with the projections projecting laterally outwardly in parallel relationship with one another and so as to be parallel with a central plane extending laterally of the panel and radially of the panel curvature.

The projections may comprise a series of pins and tubular coolant inlet and outlet connectors extending from ends of the coolant flow tube.

The tubular coolant connectors may be disposed at one end of the panel and the pins may be spaced across the panel between its ends.

The pins may be connected to the panel by means of connector straps each fastened at its ends to adjacent tube segments of the inner panel section and extending between its ends outwardly across a tube segment of the outer panel section.

The connector straps may be generally V-shaped with the root of the V-shape curved to fit about the respective tube segment of the outer panel section.

The pins may be welded to the connector straps so as to extend outwardly from the roots of the V-shapes.

BRIEF DESCRIPTION OF THE DRAWINGS

In order that the invention may be more fully explained, one particular embodiment will be described in some detail with reference to the accompanying drawings in which.

DETAILED DESCRIPTION OF THE PREFERRED EMBODIMENT

Figure 1:
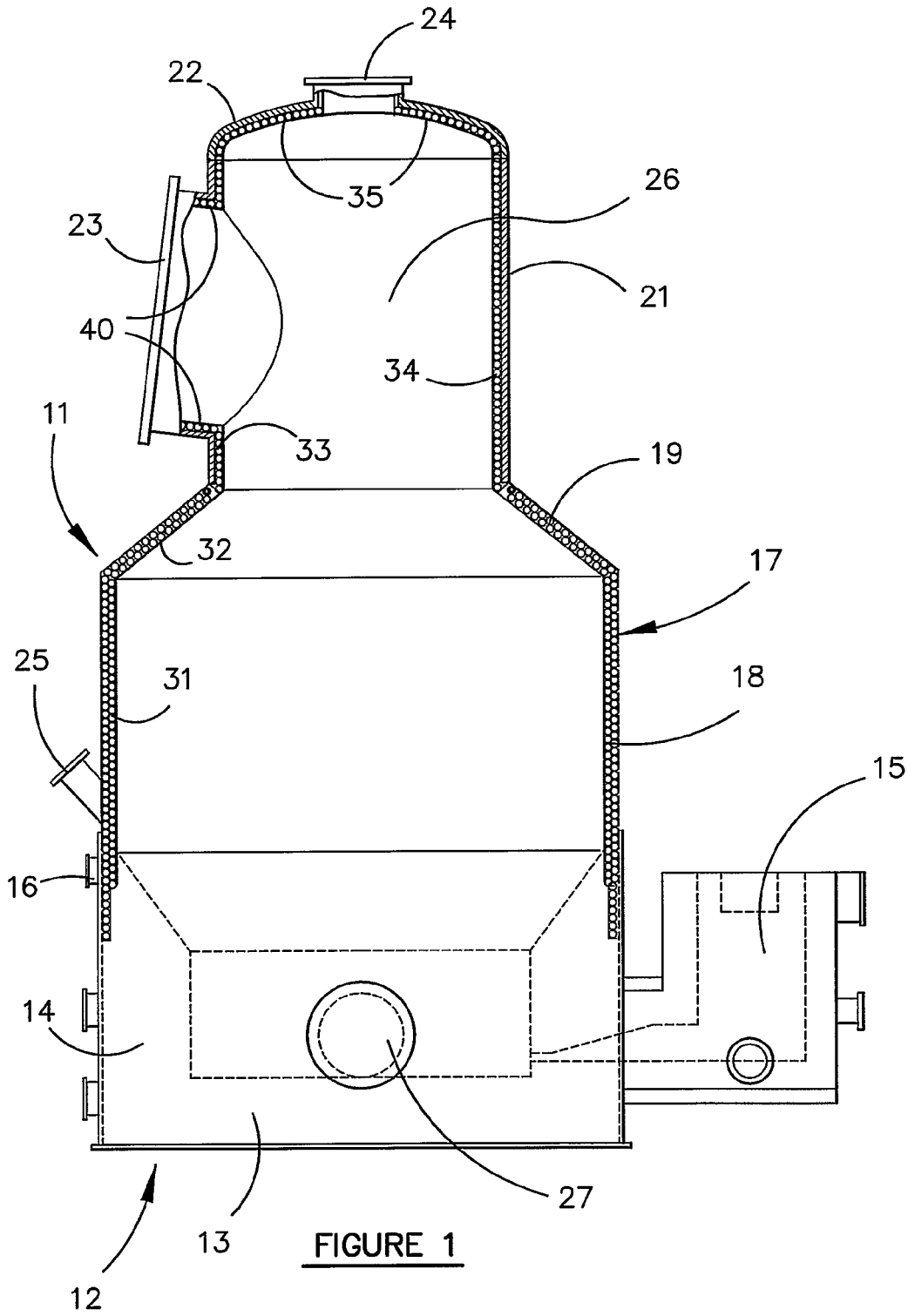
FIG. 1 is a vertical cross-section through a direct smelting vessel provided with cooling panels in accordance with the present invention.
Figure 2:
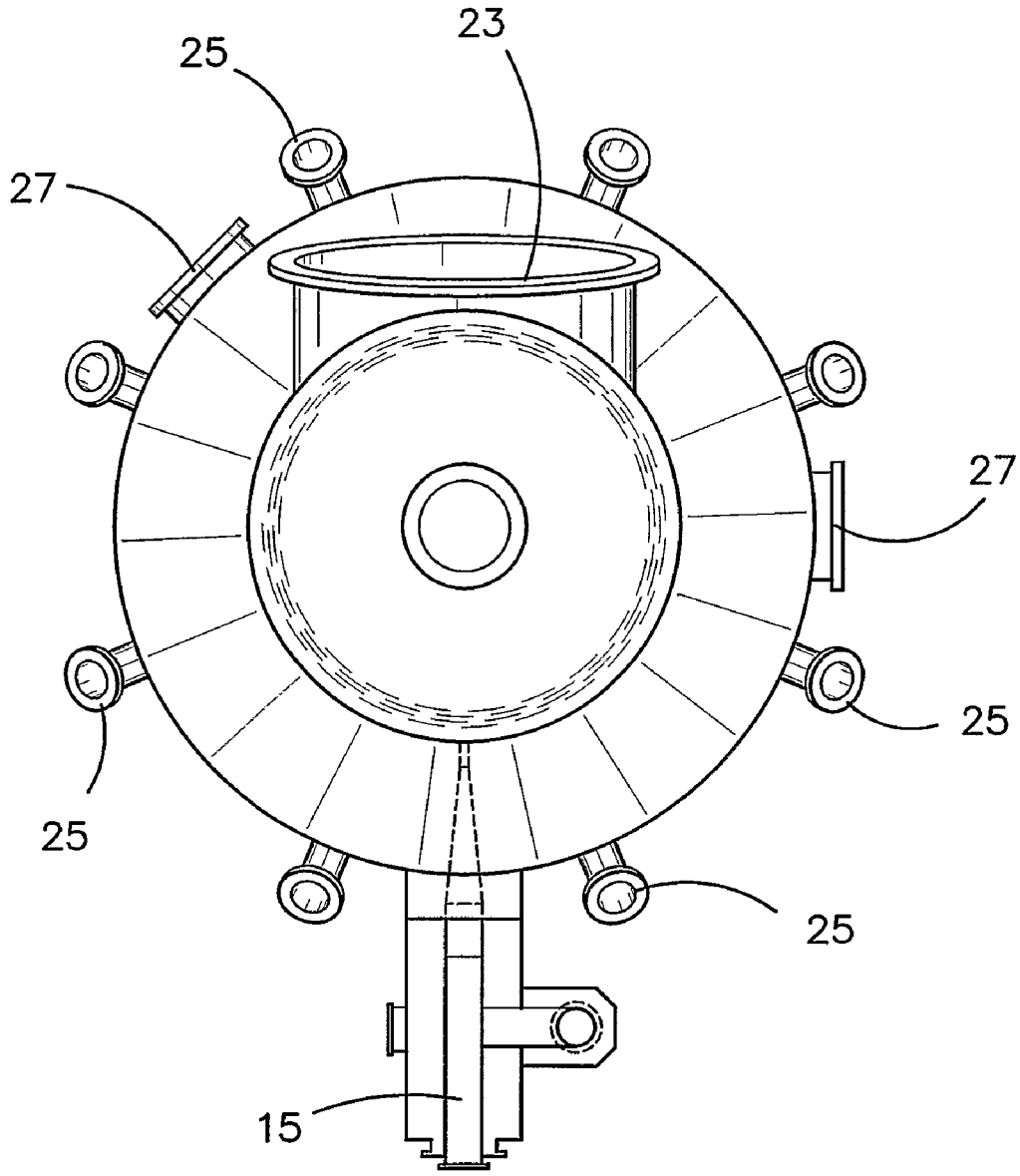
FIG. 2 is a plan view of the vessel shown in FIG. 1.

FIGS. 1 and 2 illustrate a direct smelting vessel suitable for operation of the HIsmelt process as described in U.S. Pat. No. 6,267,799 and International Patent Publication WO 96/31627. The metallurgical vessel is denoted generally as 11 and has a hearth 12 which includes a base 13 and sides 14 formed of refractory bricks, a forehearth 15 for discharging molten metal continuously and a tap hole 16 for discharging molten slag.

The base of the vessel is fixed to the bottom end of an outer vessel shell 17 made of steel and comprising a cylindrical main barrel section 18, an upwardly and inwardly tapering roof section 19, and an upper cylindrical section 21 and lid section 22 defining an offgas chamber 26. Upper cylindrical section 21 is provided with a large diameter outlet 23 for offgases and the lid 22 has an opening 24 in which to mount a downwardly extending gas injection lance for delivering a hot air blast into the upper region of the vessel. The main cylindrical section 18 of the shell has eight circumferentially spaced tubular mountings 25 through which to extend solids injection lances for injecting iron ore, carbonaceous material, and fluxes into the bottom part of the vessel.

In use the vessel contains a molten bath of iron and slag and the upper part of the vessel must contain hot gases under pressure and extremely high temperatures of the order of 1200° C. The vessel is therefore required to operate as a pressure vessel over long periods and it must be of robust construction and completely sealed. Access to the interior of the vessel is extremely limited, access essentially being limited on shut down through lid opening 24 and reline access doors 27.

Vessel shell 11 is internally lined with a set of 107 individual cooling panels through which cooling water can be circulated and these cooling panels are encased in refractory material to provide a water cooled internal refractory lining for the vessel above the smelting zone. It is important that the refractory lining be virtually continuous and that all of the refractory material be subject to cooling as uncooled refractory will be rapidly eroded. The panels are formed and attached to the shell in such a way that they can be installed internally within the shell 11 and can be removed and replaced individually on shut down without interfering with the integrity of the shell.

The cooling panels consist of a set of forty-eight panels 31 lining the main cylindrical barrel section 18 of the shell and a set of sixteen panels 32 lining the tapering roof section 19. A first set of four panels 33 line a lower part of the off-gas chamber 26 immediately above the tapering roof section 19. Twenty panels 34 line the section of the off-gas chamber 26 above the first set of four panels 33. Eleven panels 35 line the lid 22 and eight panels 40 line the outlet 23.

The panels of the off-gas chamber and the lowest row of panels in the barrel section are formed from a single layer of pipes, whereas the remaining panels of the barrel section 31 and also of the tapering roof section 19 are formed from a double layer of pipes, disposed one in front of the other relative to the vessel shell 17. The lowest row of panels 31 in the barrel section are located behind the refractory of the hearth and are closest to the molten metal. In the event of significant refractory erosion or spalling there is potential for these panels to contact molten metal and therefore are preferably constructed of copper. The remaining panels in the barrel section and also the off-gas chamber 26 may be constructed of steel.

Figure 3:
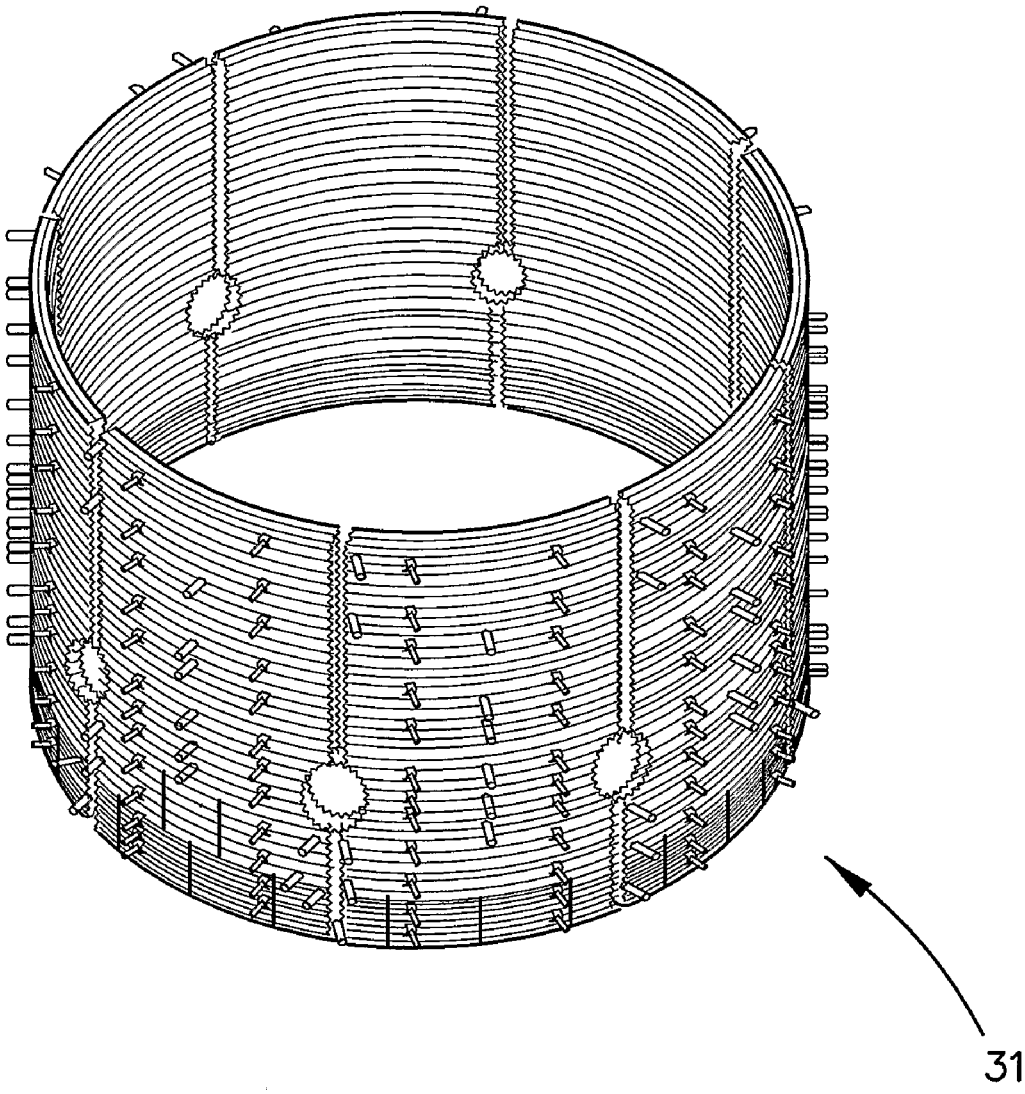
FIG. 3 illustrates the arrangement of cooling panels lining a main cylindrical barrel part of the vessel.
Figure 4:
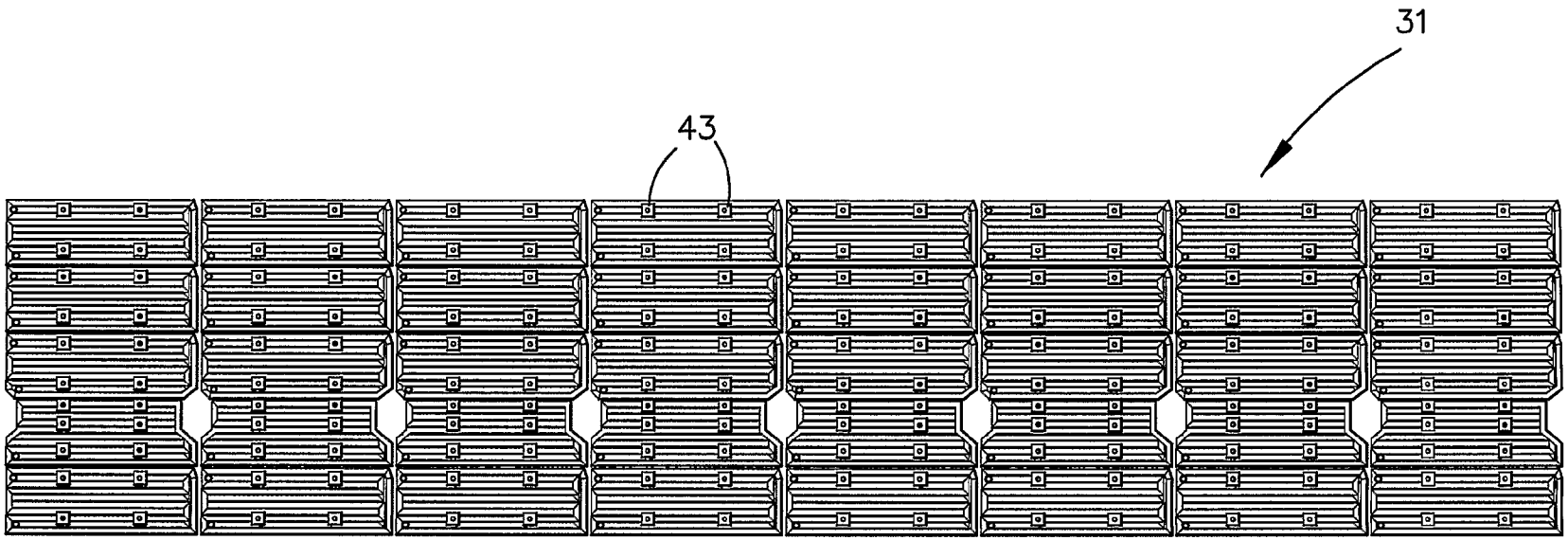
FIG. 4 is a development of the cooling panels shown in FIG. 3.
Figure 5:
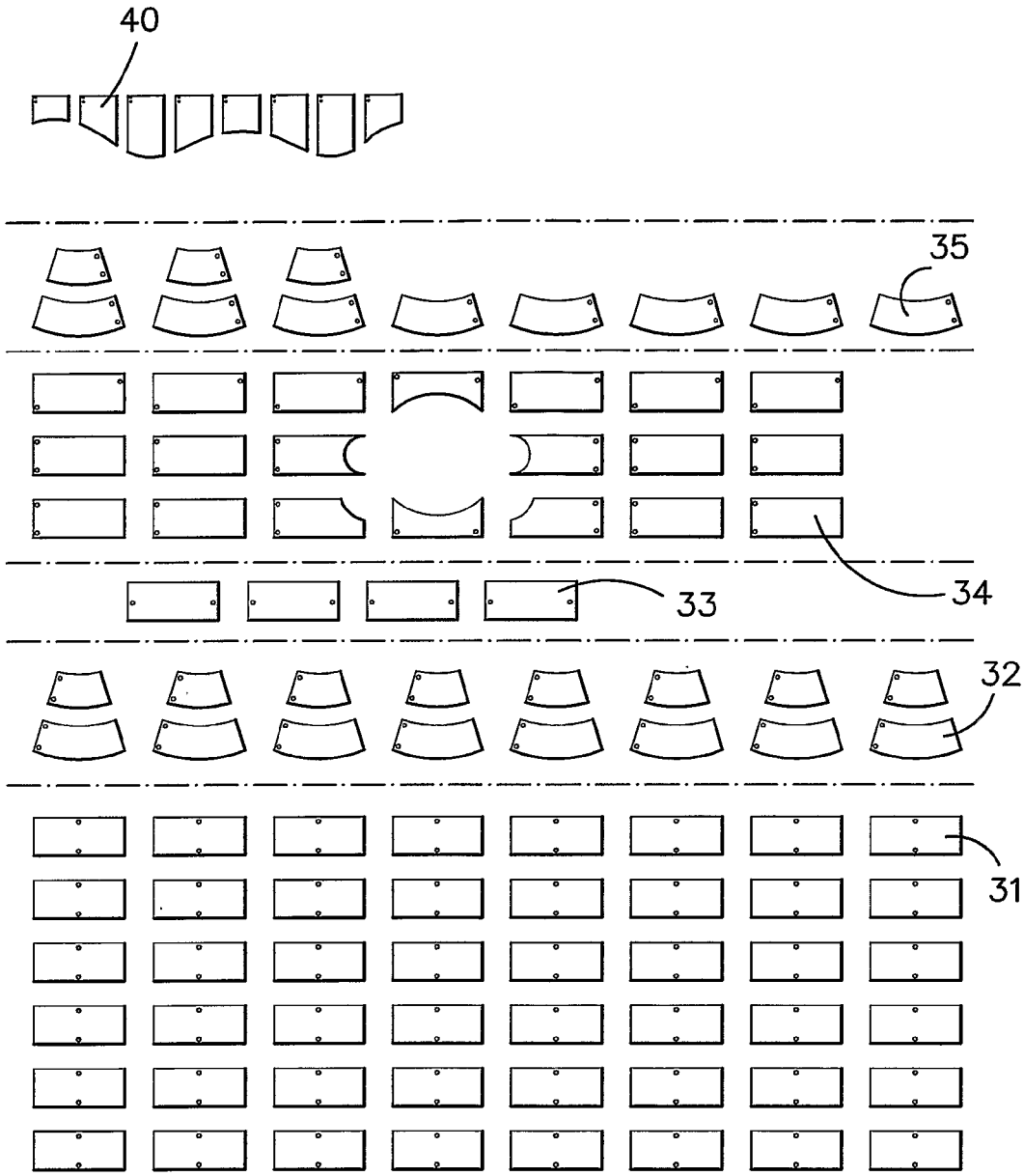
FIG. 5 is a development showing diagrammatically the complete set of cooling panels fitted to the vessel.
Figure 6:
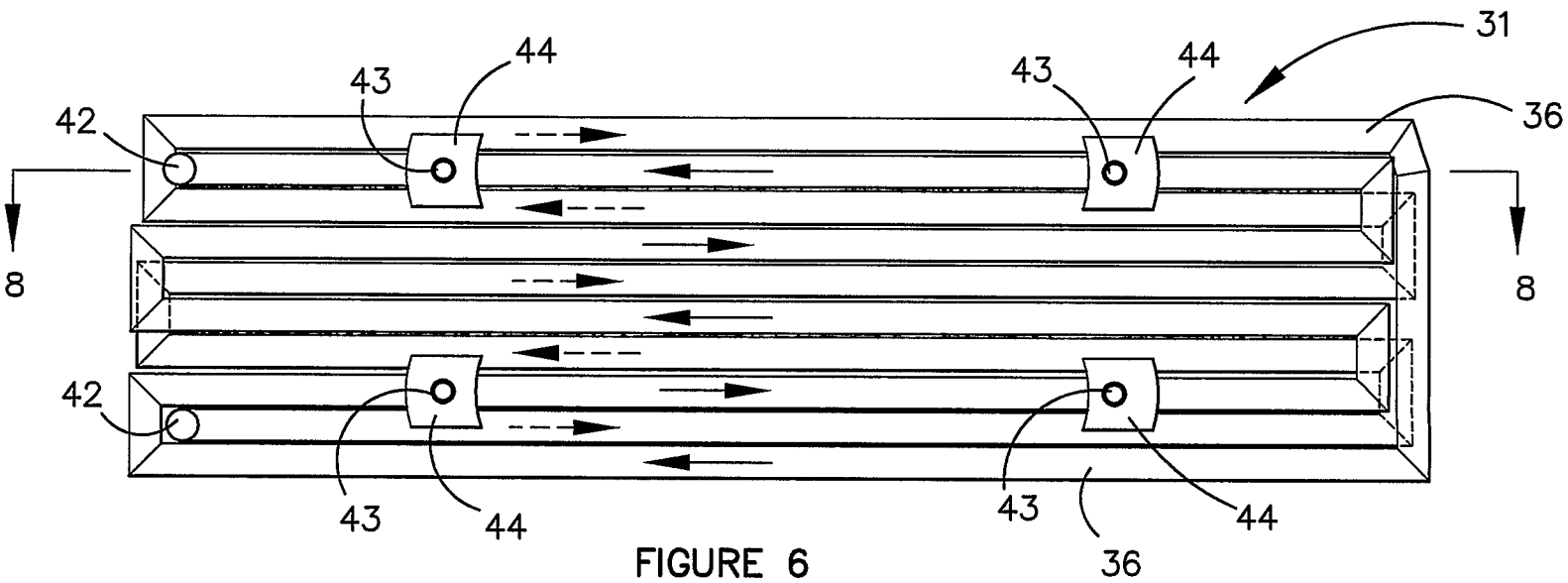
FIG. 6 is an elevation of one of the cooling panels fitted to the cylindrical barrel section of the vessel.
Figure 7:
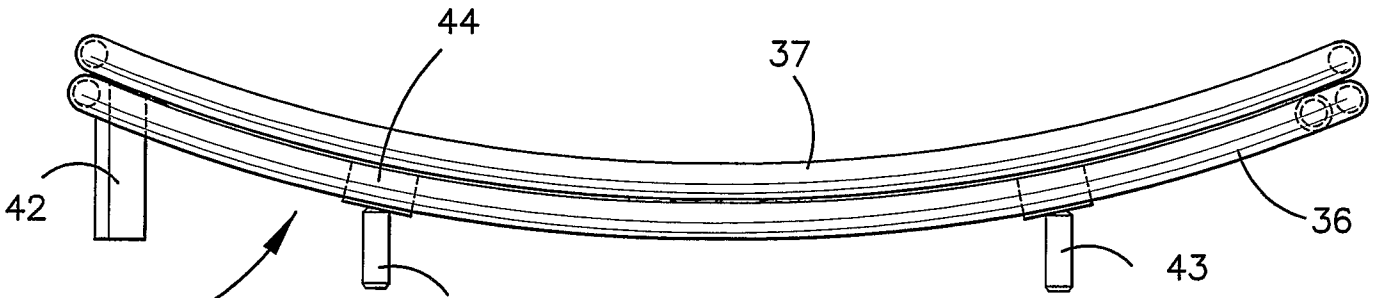
FIG. 7 is a plan of the panel shown in FIG. 7.
Figure 8:
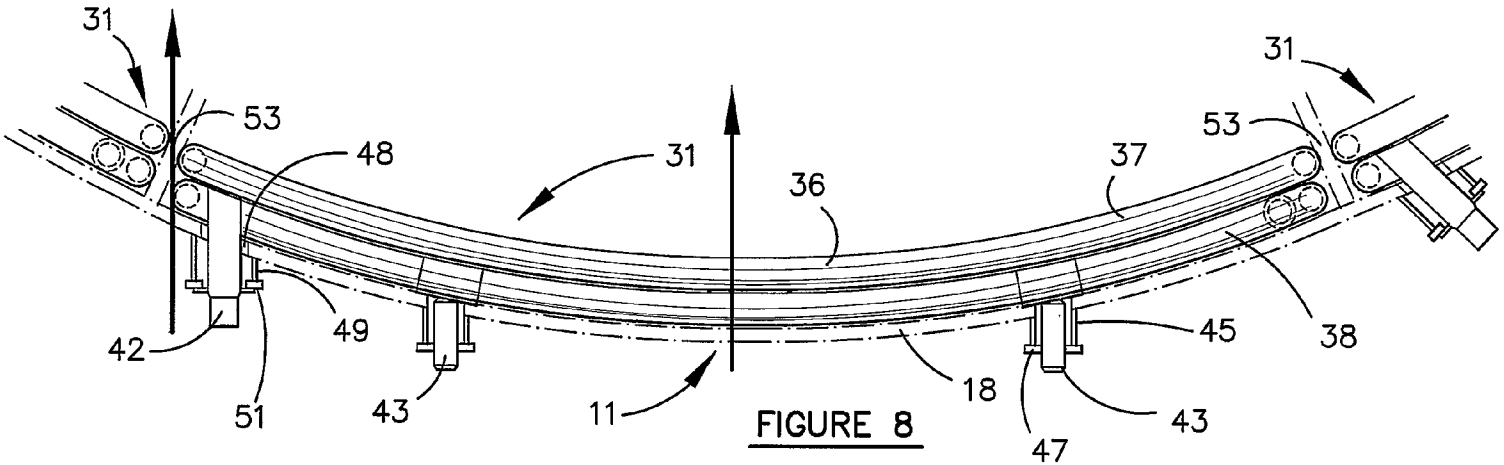
FIG. 8 is a cross-section on the line 8-8 in FIG. 6.
Figure 9:
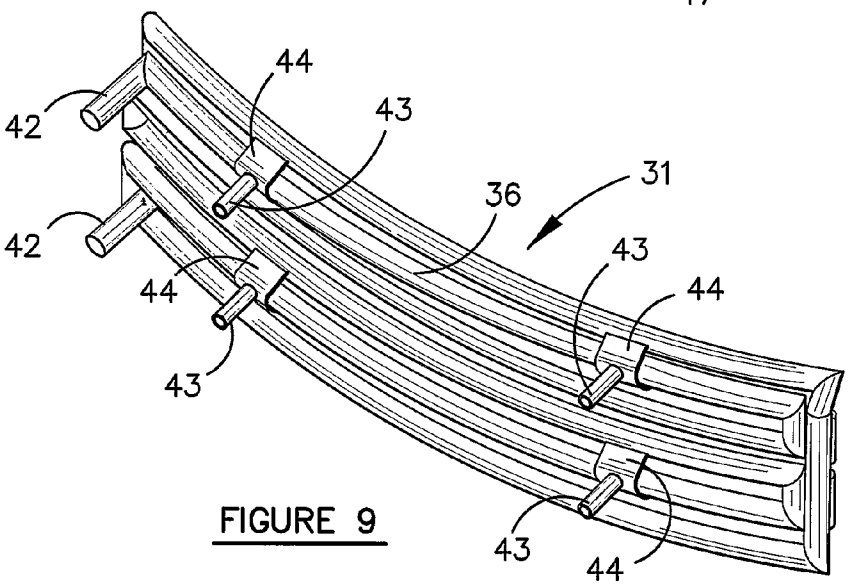
FIG. 9 is a front view of the cooling panel illustrated in FIG. 6.
Figure 10:
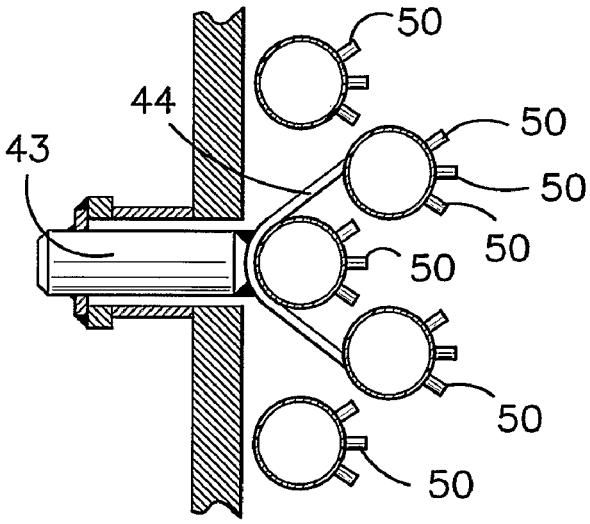
FIG. 10 illustrates a detail of the cooling panel.
Figure 11:
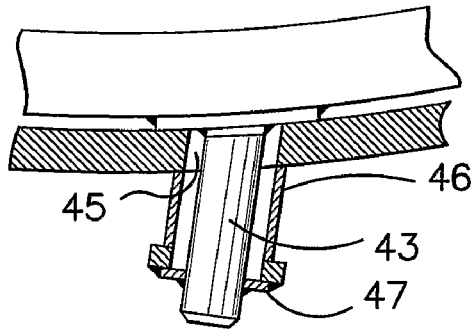
FIGS. 11 and 12 illustrate details of the connection of a cooling panel to the vessel shell.
Figure 12:
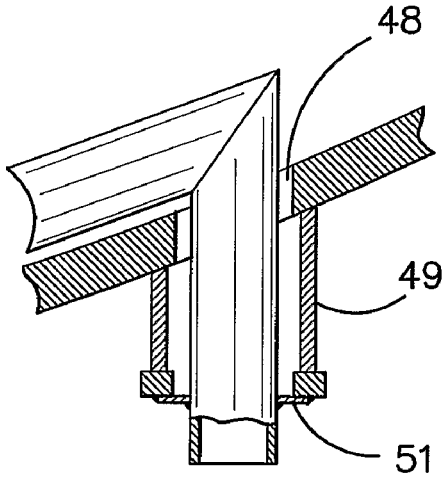

The construction of panels 31 and the manner in which they are mounted on the main cylindrical barrel 18 of the vessel shell is illustrated in FIGS. 6-12. As shown in FIGS. 3, 4 and 5, these panels are disposed in 6 vertically spaced tiers of arcuate panels spaced circumferentially of the vessel, there being eight individual panels 31 in each tier. Each panel 31 is comprised of a coolant flow tube 36 bent to form inner and outer panel sections 37, 38 of zigzag formation. The inner and outer panel sections 37, 38 are also vertically off-set such that the horizontal pipe segments of one panel section are located intermediate the horizontal pipe segments of the other panel section. Coolant inlet and outlet tubular connectors 42 extend from the inner panel section at preferably one end of each panel, though they may also extend from other sections of, or locations on, the panel.

Panels 31 are of elongate arcuate formation having greater length than height and with a curvature to match the curvature of the main cylindrical barrel section 18 of the shell. As may be seen from FIGS. 3 & 4 a series of apertures 55 are formed within the set of barrel panels 31. These apertures 55 align with the circumferentially spaced tubular mountings 25 and operate to provide clearance sufficient for solids injection lances to penetrate into the interior of the vessel 11. Typically the apertures are shaped so as to accommodate generally cylindrical solids injection lances that extend through the vessel shell 17 and the panels 31 so as to form an angle to a vertical plane tangential to the vessel shell 17 at the centre point of the penetration. The apertures 55 are formed by alignment of two or more panels having, recesses formed along an edge. The recesses may be along vertical or horizontal edges or may be at one or more corners. The tubular mountings 25 are spaced circumferentially of the vessel at a common height. The panels that form apertures 55 are of a length corresponding to the circumferential distance between tubular mountings 25 such that typically the centre line of each lance is aligned with the vertical edge of two or more adjacent panels. This arrangement results in the panels in the region of the solids injection lances having recesses along both vertical edges. These recesses may extend to the upper or lower corner of the panel.

A set of four mounting pins 43 are connected to the zigzag tubular formation of the outer panel section 38 by means of connector straps 44 so as to project laterally outwardly from the panel. Each connector strap 44 is fastened at its ends to adjacent tube segments of the inner panel section and extends between its ends outwardly across a tube segment of the outer panel section in the manner shown most clearly in FIG. 10. The connector straps 44 are generally V-shaped with the root of the V-shape curved to fit snugly about the tube segment of the outer panel section. The pins 43 are welded to the connector straps so as to extend outwardly from the roots of the V-shapes. The connecting straps serve to brace the panels by holding the tube segments securely in spaced apart relationship at multiple locations distributed throughout the panels, resulting in a strong but flexible panel construction.

The mounting pins 43 are extended through openings 45 in the shell 17 and tubular protrusions 46 surrounding the openings 45 and protruding outwardly from the shell 17. The ends of pins 43 project beyond the flanges 57 located at the outer ends of the tubular protrusions 46. The pins 43 are connected to the flanges 57 by welding annular metal discs 47 to the pins 43 and the flanges 57 thus forming connections exteriorly of the shell in a way which seals the openings 45.

In similar fashion the inlet and outlet connectors 42 for the panel project outwardly through openings 48 in the shell 17 and through and beyond tubular protrusions 49 surrounding those openings and protruding outwardly from the shell and connections are made by welding annular discs 51, between the connectors 42 and flanges 59 located on the extremity of the protrusions 49. In this way, each panel 31 is mounted on the shell through the four pins 43 and the coolant connectors 42 at individual connections exteriorly of the shell. The pins and coolant connectors are a clearance fit within the tubular protrusions tubes 46, 49. The protrusions 46, 49, the flanges 57, 59, the discs 47 and the pins 43 are rigid and have sufficient strength to support the load of the panels in a cantilevered manner from the extremity of the protrusions when the panels are operational and hence filled with cooling water and encased in refractory.

The panels 31 are removed by grinding the weld between the pins 43 and the flanges 57 and between the coolant connectors 42 and the flanges 59. In this way the panels are readily removed. The flanges 57, 59 may also be removed by grinding before replacement panels are installed. This method allows the panels to be removed with limited damage to the flanges 57, 59, the protrusions 46, 49 and hence the vessel 11.

The pins 43 and the coolant inlet and outlet connectors 42 are oriented so as to project laterally outwardly from the panel in parallel relationship to one another and so as to be parallel with a central plane extended laterally through the panel radially of the vessel so that the panel can be inserted and removed by bodily movement of the panel inwardly or outwardly of the cylindrical barrel of the vessel.

The gaps 53 between the circumferentially spaced panel 31 must be sufficient to enable the trailing outer edges of a panel being removed to clear the inner edges of the adjacent panels when the panel to be removed is withdrawn inwardly along the direction of the pins 46 and connectors 42. The size of the gaps required is dependant on the length of the arcuate panels and therefore the number of panels extending the circumference of the barrel section 18. In the illustrated embodiment there are eight circumferentially spaced panels in each of the six tiers of panels 31. It has been found that this allows minimal gaps between the panels and ensures proper cooling of refractory material at the gaps. Generally for satisfactory cooling it is necessary to divide each tier into at least six circumferentially spaced panels. Additionally, the arcuate length of an outer panel section may be less than the arcuate length of an inner panel section. Such an arrangement allows the gap 53 between the inner panel section of adjacent panels to be minimised compared with an arrangement where the outer panels section and inner panel section are of the same length.

Refractory retainer pins 50 are butt welded to the coolant tubes of panels 31 so as to project inwardly from the panels and act as anchors for the refractory material sprayed out the panels. Pins 50 may be arranged in groups of these pins radiating outwardly from the respective tube and arranged at regular spacing along the tube throughout the panel.

The panels 33 and 34, being fitted to cylindrically curved sections of the vessel, are formed and mounted in the same fashion as the panels 31 as described above, but some of the panels 34 are shaped in the manner shown in FIG. 5 so as to fit around the offgas outlet 23

The panels 32 and 35, being fitted to tapered sections of the shell, are generally conically curved in the manner shown in the illustrated development of FIG. 5. Except for this variance in shape. However, these panels are also formed and mounted to the shell in similar fashion to the panels 31, each being fitted with mounting pins projecting laterally outwardly from the panel and a pair of inlet/outlet coolant connectors at opposite ends of the panels, the pins and connectors being extended through openings in the shell and connected to tubes projecting laterally outwardly from the shell to form connections exteriorly of the shell which seal the openings and provide a secure mounting for the panels while permitting some freedom of movement of the panels.

The illustrated embodiment of the invention has been advanced by way of example only. It is to be understood that the invention is not limited to the constructional detail of this embodiment.

The invention claimed is:

1. A metallurgical vessel for a molten bath direct smelting process having free space above a molten bath and wherein metalliferous material and carbonaceous material are supplied to the bath and smelted to molten iron and slag and wherein gases released from the bath are combusted in the free space, the vessel comprising:

an outer shell having a plurality of openings, each opening surrounded by a rigid tubular protrusion that is connected rigidly to the shell and that protrudes outwardly from the shell; and a plurality of cooling panels forming an interior lining for at least an upper part of the vessel, each panel comprising a coolant flow tube shaped in a zig-zag formation to form the panel and having internal passages for flow of coolant there through between tubular coolant inlet and outlet connectors, and a plurality of rigid projections for supporting the load of the panel, which projections are connected rigidly to the flow tubes and project laterally of the panel;

wherein the plurality of rigid projections project through said openings in the outer shell and are rigidly connected to outer ends of the tubular protrusions by connections that attach the cooling panel to the outer shell and which seal the openings and support the load of the panel.

2. A vessel as claimed in claim 1, wherein said connections comprise plate members having apertures locating the projections, the plate members being welded to the projections and to the outer ends of the protrusions to seal the openings.

3. A vessel as claimed in claim 1, wherein the cooling panels are lined interiorly of the vessel with refractory material to form an interior refractory lining for the vessel, the cooling panels being operable by flow of coolant through said passages to cool the refractory material.

4. A vessel as claimed in claim 1, wherein said projections are of elongate formation and project laterally of the panel in mutually parallel relationship to one another.

5. A vessel as claimed in claim 1, wherein said projections include a series of pins.

6. A vessel as claimed in claim 5, wherein said projections further comprise tubular coolant inlet and outlet connectors for the panel.

7. A vessel as claimed in claim 1, wherein the vessel shell includes a generally cylindrical section lined with a series of said cooling panels.

8. A vessel as claimed in claim 7, wherein the panels of said series are of elongate arcuate formation with a curvature to match the curvature of the generally cylindrical section of the vessel.

9. A vessel as claimed in claim 8, wherein the panels of said series have a greater length than height.

10. A vessel as claimed in claim 8, wherein the projections project laterally outwardly in parallel relationship with one another and so as to be parallel with a central plane extending laterally of the panel and radially of the panel curvature.

11. A vessel as claimed in claim 7, wherein the panels of said series are disposed in vertically spaced tiers of panels spaced circumferentially of the vessel.

12. A vessel as claimed in claim 11, wherein the panels are closely spaced but with gaps between the circumferentially spaced panels sufficient to permit removal of each panel by bodily movement thereof.

13. A vessel as claimed in claim 12, wherein there are at least six circumferentially spaced panels in each tier.

14. A vessel as claimed in claim 1, wherein the projections are comprised of pins attached to the zigzag tube formations and tubular coolant and inlet and outlet connectors extending from ends of the zigzag tubular formations.

15. A vessel as claimed in claim 1, wherein at least a portion of the panels have inner and outer zigzag formations forming inner and outer panel sections relative to the vessel shell.

16. A vessel as claimed in claim 15, wherein the arcuate length of the outer panel section is less than the arcuate length of the inner panel section thereby allowing a gap between vertical edges of adjacent panels to be minimised.

17. A vessel as claimed in claim 15, wherein said inner panel section and said outer panel section are vertically offset such that one or more horizontal pipe segments of one panel section are located intermediate horizontal pipe segments of the other panel section.

18. A vessel as claimed in claim 1 and further comprising a refractory lined hearth, a barrel section disposed above the refractory lined hearth and an off-gas chamber disposed above the barrel section.

19. A vessel as claimed in claim 18, wherein a portion of the barrel section is lined with double layer panels and the off-gas chamber is lined with single layer panels.

20. A vessel as claimed in claim 19, wherein only a lowest row of panels in said barrel section comprise single layer panels.

21. A vessel as claimed in claim 1, wherein said vessel locates a plurality of solids injection lances each extending through one of a plurality of apertures in the outer shell into an interior region of the vessel and said plurality of cooling panels provide a plurality of apertures corresponding to said apertures in the outer shell whereby said lances extend through said panels into said interior of said vessel.

22. A vessel as claimed in claim 21, wherein at least one said aperture is provided by a recess located on an edge of at least one panel.

23. A vessel as claimed in claim 22, wherein said at least one aperture is provided by alignment of at least two recesses located along edges or at corners of two or more panels.

24. A vessel as claimed in claim 21, wherein the lances are located at a common height on the vessel shell at least some of the panels located at said height of said lances having a length corresponding substantially to the arcuate distance between the lances.

25. A cooling panel for mounting on an outer shell of a metallurgical vessel so as to form part of an internal lining of that shell, the vessel being suitable for a molten bath direct smelting process having free space above a molten bath and wherein metalliferous material and carbonaceous material are supplied to the bath and smelted to molten iron and slag and wherein gases released from the bath are combusted in the free space, the cooling panel comprising:

a curved panel body being formed of a single coolant tube shaped to form a zigzag configuration, the coolant tube having an internal passage means for flow of coolant therethrough between tubular coolant inlet and outlet connectors, and a plurality of rigid projections projecting laterally of the panel to one side of the panel body, the projections being capable of supporting the panel when extended through openings in the shell and rigidly connected to the shell exteriorly of the vessel.

26. A cooling panel as claimed in claim 25, wherein the panel body is formed of a single coolant tube shaped to form adjacent inner and outer panel sections of zig zag formation and said projections project laterally outwardly from the outer panel section.

27. A cooling panel as claimed in claim 26, wherein said inner panel section and said outer panel section are vertically off-set such that one or more horizontal pipe segments of one panel section are located intermediate horizontal pipe segments of the other panel section.

28. A cooling panel as claimed in claim 26 wherein the length of the outer panel section is less than the length of the inner panel section thereby in use allowing a gap between vertical edges of adjacent panels to be minimised.

29. A cooling panel as claimed in claim 26, wherein the panel is of elongate arcuate formation and the outer panel section is disposed on the outer side of the panel curve with the projections projecting laterally outwardly in parallel relationship with one another and so as to be parallel with a central plane extending laterally of the panel and radially of the panel curvature.

30. A cooling panel as claimed in claim 26, wherein said panel is of elongate arcuate formation having a greater length than height.

31. A cooling panel as claimed in claim 26, wherein the projections comprise a series of pins and tubular coolant inlet and outlet connectors extending from ends of the coolant flow tube.

32. A cooling panel as claimed in claim 31, wherein the tubular coolant connectors are disposed at one end of the panel and the pins are spaced across the panel between its ends.

33. A cooling panel as claimed in claim 31, wherein the pins are connected to the panel by means of connector straps each fastened at its ends to adjacent tube segments of the inner panel section and extending between its ends outwardly across a tube segment of the outer panel section.

34. A cooling panel as claimed in claim 33, wherein the connector straps are generally V-shaped with the root of the V-shape curved to fit about the respective tube segment of the outer panel section.

35. A cooling panel as claimed in claim 33, wherein the pins are welded to the connector straps so as to extend outwardly from the roots of the V-shapes.

36. A method of mounting a cooling panel on an outer shell of a metallurgical vessel so as to form part of an internal lining of that shell, the vessel being suitable for a molten bath direct smelting process having free space above a molten bath and wherein metalliferous material and carbonaceous material are supplied to the bath and smelted to molten iron and slag and wherein gases released from the bath are combusted in the free space, the cooling panel having a coolant flow tube shaped in a zigzag formation to form the panel and having internal passages for flow of coolant therethrough between tubular coolant inlet and outlet connectors, the method comprising:

providing the cooling panel with a plurality of projections projecting laterally from the panel, providing the outer shell of the vessel with a plurality of openings to receive the panel projections and with rigid tubular protrusions surrounding the openings and protruding outwardly from the shell, extending the projections through openings in the shell to bring the panel into a position in which it lines part of the interior of the shell, and forming rigid connections between each of the projections and respective outer ends of the tubular protrusions on the outside of the shell which connections mount the panel on the outer shell and to seal the openings and to support the load of the panel.

37. A method as claimed in claim 36, wherein the shell is provided with tubular protrusions surrounding said openings and protruding outwardly from the shell and said connections are formed between the projections and the outer ends of the tubular protrusions.

38. A method as claimed in claim 36, wherein the projections include the tubular coolant inlet and outlet connectors.

* * * * *